United States Patent [19]

Okuya et al.

[11] 4,404,540

[45] Sep. 13, 1983

[54] SLIDE RHEOSTAT

[75] Inventors: Tsutae Okuya; Nobuaki Anzai, both of Miyagi, Japan

[73] Assignee: Alps Electric Co., Ltd., Japan

[21] Appl. No.: 367,757

[22] Filed: Apr. 12, 1982

[30] Foreign Application Priority Data

Apr. 13, 1981 [JP] Japan ..... 56/52910

[51] Int. Cl.[3] ..... H01C 10/30

[52] U.S. Cl. ..... 338/161; 338/176

[58] Field of Search ..... 338/160, 161, 176, 183, 338/184, 188, 194

[56] References Cited

U.S. PATENT DOCUMENTS 2,242,327 5/1941 Rubinstein ..... 338/183
3,594,678 7/1971 Nomura ..... 338/183
3,639,880 2/1972 Oka ..... 338/176 X
4,274,074 6/1981 Sakamoto ..... 338/176

*Primary Examiner*—C. L. Albritton
*Attorney, Agent, or Firm*—Guy W. Shoup; Gerard F. Dunne

[57] ABSTRACT

A slide rheostat wherein a movable insulating plate and a leaf spring which are centrally provided with holes for receiving a lever of a slide piece receiver are made unitary by mounting a flat portion of the leaf spring on the movable insulating plate by outsert molding, the unitary movable insulating plate and leaf spring have the lever inserted therethrough. Resilient protuberant pieces are disposed at the four corners of the flat portion of the leaf spring and held in resilient contact with the upper surface of the slide piece receiver, and the movable insulating plate is held in resilient contact with the upper rear surface of a case through the action of the leaf spring.

1 Claim, 4 Drawing Figures

SLIDE RHEOSTAT

BACKGROUND OF THE INVENTION

The present invention relates to a slide rheostat, and more particularly to improvements in the mounting structure of a leaf spring and a movable insulating plate which are mounted on a for the slide element receiver in order to achieve smooth sliding of the receiver.

As shown in FIG. 1, a prior-art slide rheostat having the aforecited structure is so constructed that a slot 2*b* is formed in the lengthwise direction of the top of a case 2 fixed to an insulating substrate 1, and a lever 5 extending upwardly from a receiver 4 projects out from the case 2 through the slot 2*b*. The receiver can be moved in the lengthwise direction of the case 2 by manipulating the lever 5, and a contactor 8*a* of a slide element 8 is fastened to the underside of the receiver 4 and held in resilient contact with the substrate 1. In order to attain smooth sliding of the receiver 4, slide rheostat are often so constructed with a movable insulating plate 6 urged against the inner surface of the top wall of the case 2 by a leaf spring 7 carried on the upper surface 4*a* of the receiver 4. The lower 5 extends through the plate 6 and leaf spring 7 and resilient protuberant pieces 7*d* are disposed at the four corners of the leaf spring 7 in a manner so as to extend upwardly into resilient contact with the movable insulating plate 6. In FIG. 1, symbol 2*a* indicates screw holes for fixation which are formed in the opposing end parts of the case 2, symbol 4*b* guide legs which are formed at the four corners of each of the upper and lower surfaces of the slide piece receiver 4, and numeral 3 terminals.

With the prior-art construction, the movable insulating plate 6 and the leaf spring 7 are separate members and must be individually installed on the lever 5 in the assemblage of the slide rheostat. The prior art therefore has the drawbacks of an inferior job efficiency, a complicated management of the components including mixing and the like problems.

SUMMARY OF THE INVENTION

The present invention has been made in order to eliminate the drawbacks described above, and has for its object to provide a slide rheostat which has an improved mounting structure of a leaf spring and a movable insulating plate.

According to one aspect of the present invention, a slide rheostat comprises a case, a receiver received in said case, a lever which protrudes from said receiver in a manner to extend out from said case, a movable insulating plate which is centrally provided with a hole for inserting said lever therethrough, and a leaf spring which includes a flat central portion and resilient protuberant pieces disposed at the corners of said central portion. The movable insulating plate and said leaf spring are made unitary by mounting said central portion of the latter on the former by outsert molding, with the unitary movable insulating plate and leaf spring having said lever inserted therethrough. The resilient protuberant pieces are held in elastic contact with an upper surface of said receiver, said the movable insulating plate is held in resilient contact with an upper rear surface of said case through the resiliency of said leaf spring.

BRIEF DESCRIPTION OF THE DRAWINGS

FIGS. 2, 3*a* and 3*b* concern an embodiment of the present invention, in which FIG. 2 is a perspective view showing a movable insulating plate and a leaf spring, FIG. 3*a* is a sectional front view of essential portions, and FIG. 3*b* is a sectional side view of the essential portions.

PREFERRED EMBODIMENT OF THE INVENTION

Figure 1:
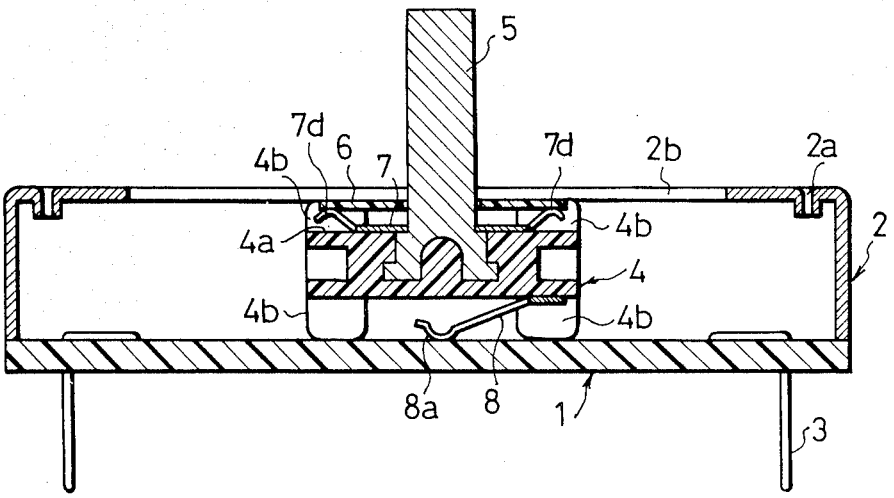
Fig.1 PRIOR ART
FIG. 1 is a sectional front view of a prior-art slide rheostat.

Hereunder the present invention will be described with reference to FIG. 2 and FIGS. 3*a* and 3*b*, in which components having the same functions as in the foregoing prior-art slide rheostat are assigned the same reference numerals.

Figure 2:
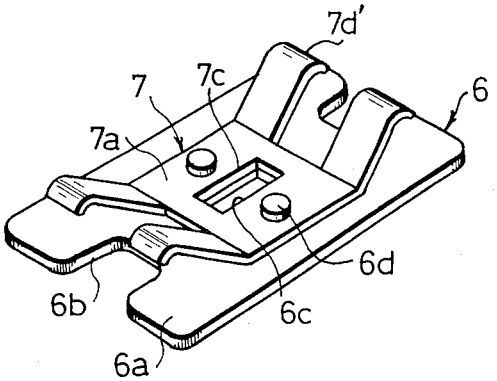

In FIG. 2, numeral 6 designates a movable insulating plate made of a synthetic resin. It includes a flat base portion 6*a*, notches 6*b* formed centrally in the end portions of the base portion 6*a* in order to avoid the fixing screw holes 2*a* of the case 2, and a square hole 6*c* which is provided centrally of the base portion 6*a* in order to receive the lever 5 of the slide piece receiver 4 therethrough. Shown at symbol 6*d* are a pair of protrusions extending upwardly from base portion 6*a*. Numeral 7 designates a leaf spring made of a metal. It includes a central portion 7*a*, a hole 7*c* for receiving the lever 5 therethrough, and resilient protuberant pieces 7*d* which are disposed at the four corners of the central portion 7*a*. The movable insulating plate 6 and the leaf spring 7 have their base and central portions 6*a* and 7*a* placed one over the other so that the holes 6*c* and 7*c* for receiving the lever 5 therethrough may be aligned. The insulating plate 6 and the leaf spring 7 are made unitary by outsert molding so that they may be fastened to each other by the pair of protrusions 6*d* of the movable insulating plate 6 inserted through holes (not shown) of the leaf spring 7.

Figure 3A:
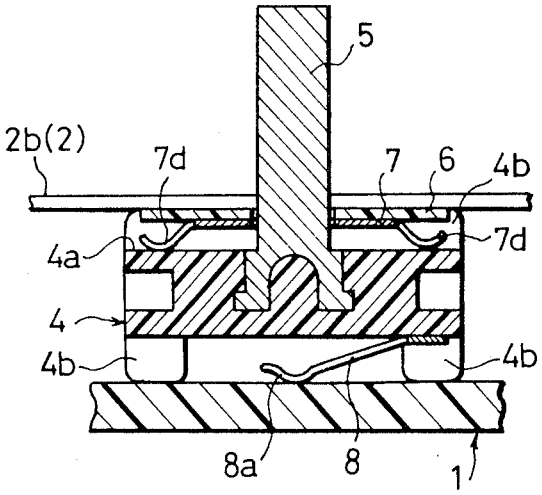
Figure 3B:
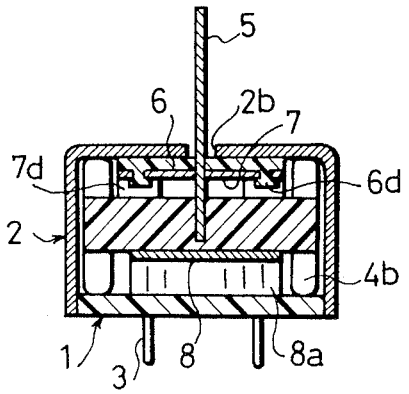

As shown in FIG. 3*a*, the unitary movable insulating plate 6 and leaf spring 7 have the lever 5 inserted therethrough. The movable insulating plate 6 and the leaf spring 7 are installed on the receiver 4 in the state in which the resilient protuberant pieces 7*d* extending from the central portion 7*a* of the leaf spring 7 are held in resilient contact with the upper surface 4*a* of the receiver 4. The movable insulating plate 6 is held in resilient contact with the upper rear surface of the case 2 through the action of the leaf spring 7, and the slide piece 8 is also held in resilient contact with the substrate 1.

As set forth above, according to the present invention, the movable insulating plate 6 and the leaf spring 7 are made into an integral component prior to assemblage. This brings forth such advantages that the assemblage is simple and that the component management of the components is simplified.

We claim:

1. A slide rheostat comprising a case, receiver received in said case, a lever extending outwardly of said case from said receiver, a movable insulating plate having a central hole for receiving said lever therethrough, and a leaf spring including a central portion and resilient protuberant pieces disposed at peripheral portions of said central portion, said movable insultating plate and said leaf spring being made unitary by mounting said central portion of the latter on the former, the unitary movable insulating plate and leaf spring receiving said lever therethrough, said protuberant pieces being held in resilient contact with an upper surface of said case through the resiliency of said leaf spring.

* * * * *